US008662404B2

(12) United States Patent
York et al.

(10) Patent No.: US 8,662,404 B2
(45) **Date of Patent: *Mar. 4, 2014**

(54) METHODS AND APPARATUS FOR HEATING AIR WITH HOT WATER

(71) Applicants: James Stuart York, Sharpsburg, GA (US); Hugh L. Allen-Magande, Atlanta, GA (US)

(72) Inventors: James Stuart York, Sharpsburg, GA (US); Hugh L. Allen-Magande, Atlanta, GA (US)

(73) Assignee: Rinnai America Corporation, Peachtree City, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/733,409

(22) Filed: Jan. 3, 2013

(65) Prior Publication Data

US 2013/0186967 A1 Jul. 25, 2013

Related U.S. Application Data

(63) Continuation of application No. 11/789,219, filed on Apr. 24, 2007, now Pat. No. 8,353,463.

(51) Int. Cl.

| | |
|---|---|
| ***F24D 3/02*** | (2006.01) |
| ***F24D 3/08*** | (2006.01) |
| *F24D 19/10* | (2006.01) |
| *G05B 13/00* | (2006.01) |
| *G05D 23/00* | (2006.01) |

(52) U.S. Cl.
USPC ..... 237/19; 237/8 R; 700/276

(58) Field of Classification Search
USPC ..... 237/8 R, 19; 700/276
See application file for complete search history.

(56) References Cited

U.S. PATENT DOCUMENTS

| | | | |
|---|---|---|---|
| 1,715,040 | A | 9/1926 | Mauck |
| 2,529,977 | A | 3/1949 | Thomas |
| 2,533,508 | A | 12/1950 | Riu |
| 2,562,023 | A | 7/1951 | Dufault |
| 2,573,364 | A | 10/1951 | Scharff |
| 2,576,719 | A | 11/1951 | Koser |
| 2,643,323 | A | 6/1953 | Carlson |
| 2,654,361 | A | 10/1953 | Losching |
| 2,689,560 | A | 9/1954 | Johnson |
| 2,741,242 | A | 4/1956 | Austin |
| 2,781,174 | A | 2/1957 | Smith |
| 2,789,769 | A | 4/1957 | Dalin |
| 2,813,683 | A | 11/1957 | Dillman |

(Continued)

FOREIGN PATENT DOCUMENTS

| | | |
|---|---|---|
| GB | 2160967 | 1/1986 |
| JP | 63247549 | 10/1988 |
| JP | 1142906 | 2/1999 |

*Primary Examiner* — Kang Hu
*Assistant Examiner* — Phillip E Decker
(74) *Attorney, Agent, or Firm* — Altera Law Group, LLC

(57) ABSTRACT

A method controls an air handler that generates heated air from hot water generated by a water heater. The method includes generating a signal in the presence or absence of an indicia of water flow associated with the water heater; initiating operation of a pump associated with the air handler when the signal indicates that water flow associated with the water heater is at least at a selected level to supply hot water to the air handler sufficient to generate heated air; and/or terminating operation of the pump and/or a blower/fan associated with the air handler when the presence or absence signal indicates that the water flow associated with the water heater is less than the selected level.

9 Claims, 6 Drawing Sheets

(56) References Cited

U.S. PATENT DOCUMENTS

| | | | | | |
|---|---|---|---|---|---|
| 2,822,136 | A | | 2/1958 | Dalin | |
| 2,827,893 | A | | 3/1958 | Ribaudo | |
| 3,033,192 | A | | 5/1962 | Bogren | |
| 3,144,207 | A | | 8/1964 | Sahler | |
| 3,181,793 | A | | 5/1965 | Maccracken | |
| 3,201,045 | A | | 8/1965 | Davidson | |
| 3,672,442 | A | * | 6/1972 | Singh et al. | 165/221 |
| 3,896,992 | A | | 7/1975 | Borovina et al. | |
| 4,257,745 | A | | 3/1981 | Thur | |
| 4,371,111 | A | | 2/1983 | Pernosky | |
| 4,381,075 | A | * | 4/1983 | Cargill et al. | 237/19 |
| 4,501,261 | A | | 2/1985 | Tsutsui et al. | |
| 4,738,394 | A | | 4/1988 | Ripka et al. | |
| 4,798,240 | A | | 1/1989 | Gerstmann et al. | |
| 4,819,587 | A | | 4/1989 | Tsutsui et al. | |
| 4,823,770 | A | | 4/1989 | Loeffler | |
| 4,848,655 | A | | 7/1989 | Woodin et al. | |
| 4,922,861 | A | | 5/1990 | Tsutsui et al. | |
| 5,039,007 | A | | 8/1991 | Wolter | |
| 5,046,478 | A | | 9/1991 | Clawson | |
| 5,074,464 | A | | 12/1991 | Moore, Jr. | |
| 5,076,494 | A | | 12/1991 | Ripka | |
| 5,092,519 | A | | 3/1992 | Staats | |
| 5,322,216 | A | | 6/1994 | Wolter | |
| 5,544,645 | A | | 8/1996 | Armijo et al. | |
| 6,032,868 | A | | 3/2000 | DiMarco | |
| 6,857,578 | B2 | | 2/2005 | Alvarez et al. | |
| 7,077,155 | B2 | | 7/2006 | Giammaria | |
| 7,225,995 | B2 | | 6/2007 | Sanchez | |
| 7,597,066 | B2 | | 10/2009 | Shimada et al. | |
| 7,628,337 | B2 | | 12/2009 | Cuppetilli et al. | |
| 2003/0172667 | A1 | | 9/2003 | Takano et al. | |
| 2004/0227003 | A1 | | 11/2004 | Alvarez et al. | |
| 2006/0291838 | A1 | | 12/2006 | Sturm et al. | |
| 2007/0157634 | A1 | | 7/2007 | Hartge | |
| 2007/0257122 | A1 | | 11/2007 | Shimada et al. | |
| 2008/0011245 | A1 | | 1/2008 | Donnelly | |
| 2008/0216770 | A1 | | 9/2008 | Humphrey et al. | |

* cited by examiner

METHODS AND APPARATUS FOR HEATING AIR WITH HOT WATER

TECHNICAL FIELD

The technology herein relates to methods and apparatus for heating air with hot water.

BACKGROUND

There are many ways of heating air used as space heat for domestic and commercial buildings. One way is to employ an air handler in conjunction with a water heater, wherein the water heater supplies hot water to the air handler to generate heated air. Oftentimes, however, the water heater serves the additional function of supplying potable water. Thus, there are instances when the ordinary domestic use of water, oftentimes referred to as "water draw," are above or equal to the output flow capacity of the water heater. This can lead to conditions where the air handler is deprived of sufficiently hot water flow. Such a loss of water flow to the air handler pump can lead to cavitation of the impeller, thereby considerably shortening the life of the pump. Also, low or no water flow to the air handler can lead to reduced energy transfer through the air handler heat exchanger and lower the delivered air temperature such that the air handler blows cold air into the space instead of the desired heated air.

SUMMARY

I provide a method of controlling an air handler that generates heated air from hot water generated by a water heater comprising generating a signal in response to presence or absence of an indicia of water flow associated with the water heater; initiating operation of a pump associated with the air handler when the signal indicates that water flow associated with the water heater is at least at a selected level to supply hot water to the air handler sufficient to generate heated air; and/or terminating operation of the pump and/or a blower/fan associated with the air handler when the presence or absence of the signal indicates that the water flow associated with the water heater is less than the selected level.

I also provide a method of heating air in an air handler from hot water generated in a water heater comprising receiving a call for heated air; monitoring presence or absence of a signal received from the water heater, the signal being an indicia of a selected water flow associated with the water heater; initiating operation of a water pump associated with the air handler in response to the signal or absence of the signal; initiating operation of a blower/fan to supply heated air generated by heat exchange with the hot water; and terminating operation of the pump and/or blower/fan when the call for heated air is satisfied and/or in response to the presence or absence of the signal to provide hot water to the air handler.

I further provide a method of heating air in an air handler from hot water generated in a water heater comprising receiving a call for heated air; initiating operation of a pump associated with the air handler; detecting whether flow of water through the pump is at a selected level sufficient to generate heated air from the hot water; maintaining the pump in operation; initiating operation of a blower/fan to supply heated air generated by heat exchange with the hot water; and terminating operation of the pump and/or the blower/fan when the call for heat is satisfied.

I still further provide a system for generating heated air comprising a water heater comprising a burner and a water heater exchanger to produce hot water, a pump operative to flow water out of the water heater, and a controller connected to monitor water flow indicia and generate a signal associated with the water flow indicia; an air handler comprising a blower/fan and an air handler heat exchanger to generate heated air from hot water, a pump operative to receive hot water from the water heater for passage to the air handler heat exchanger, and a controller operative to control the air handler pump and/or the blower/fan in response to the signal or absence of the signal.

DETAILED DESCRIPTION

Figure 1:
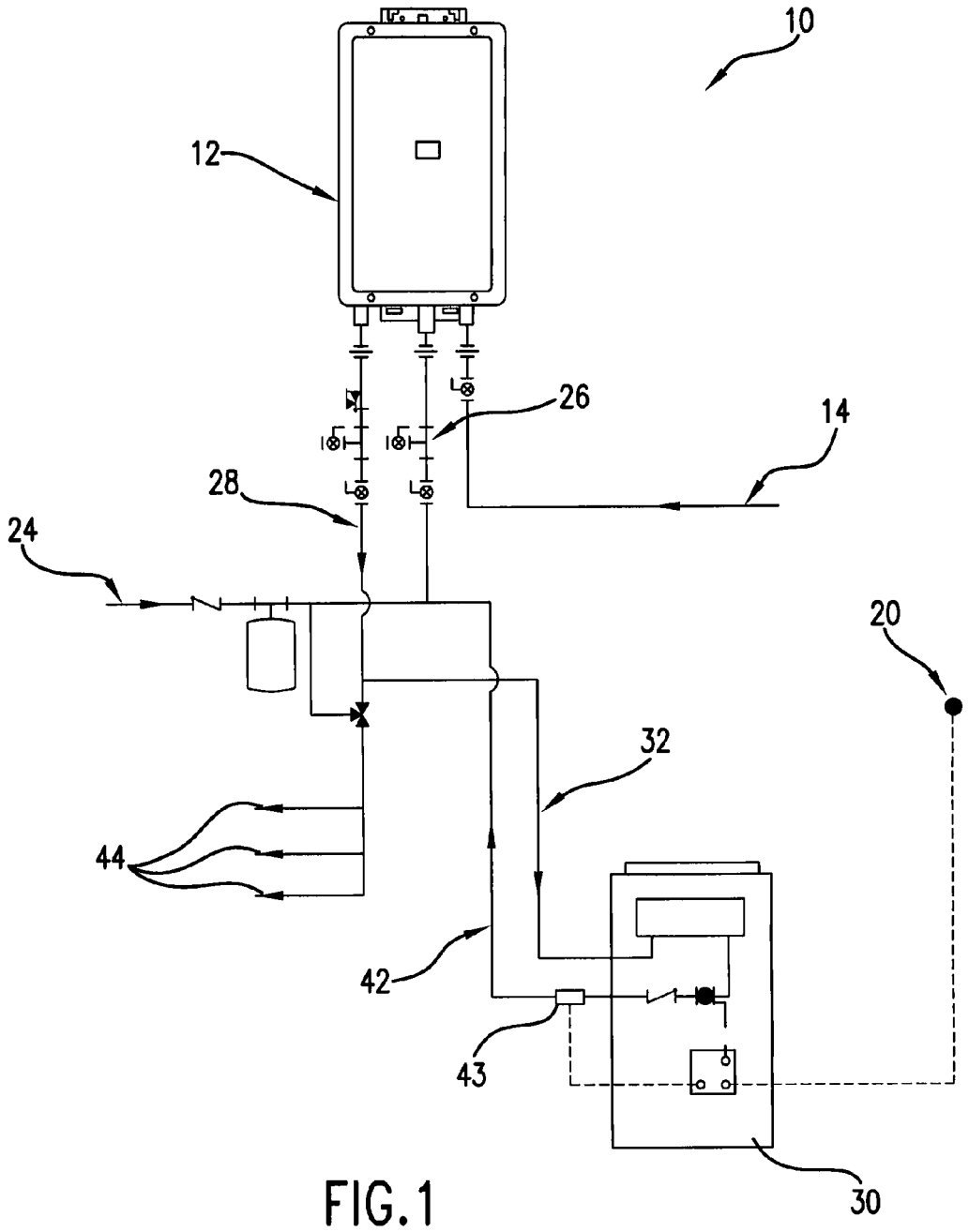
FIG. 1 is a schematic view of a system for generating heated air utilizing hot water.

It will be appreciated that the following description is intended to refer to specific, representative structures selected for illustration in the drawings and is not intended to define or limit the disclosure, other than in the appended claims.

Figure 2:
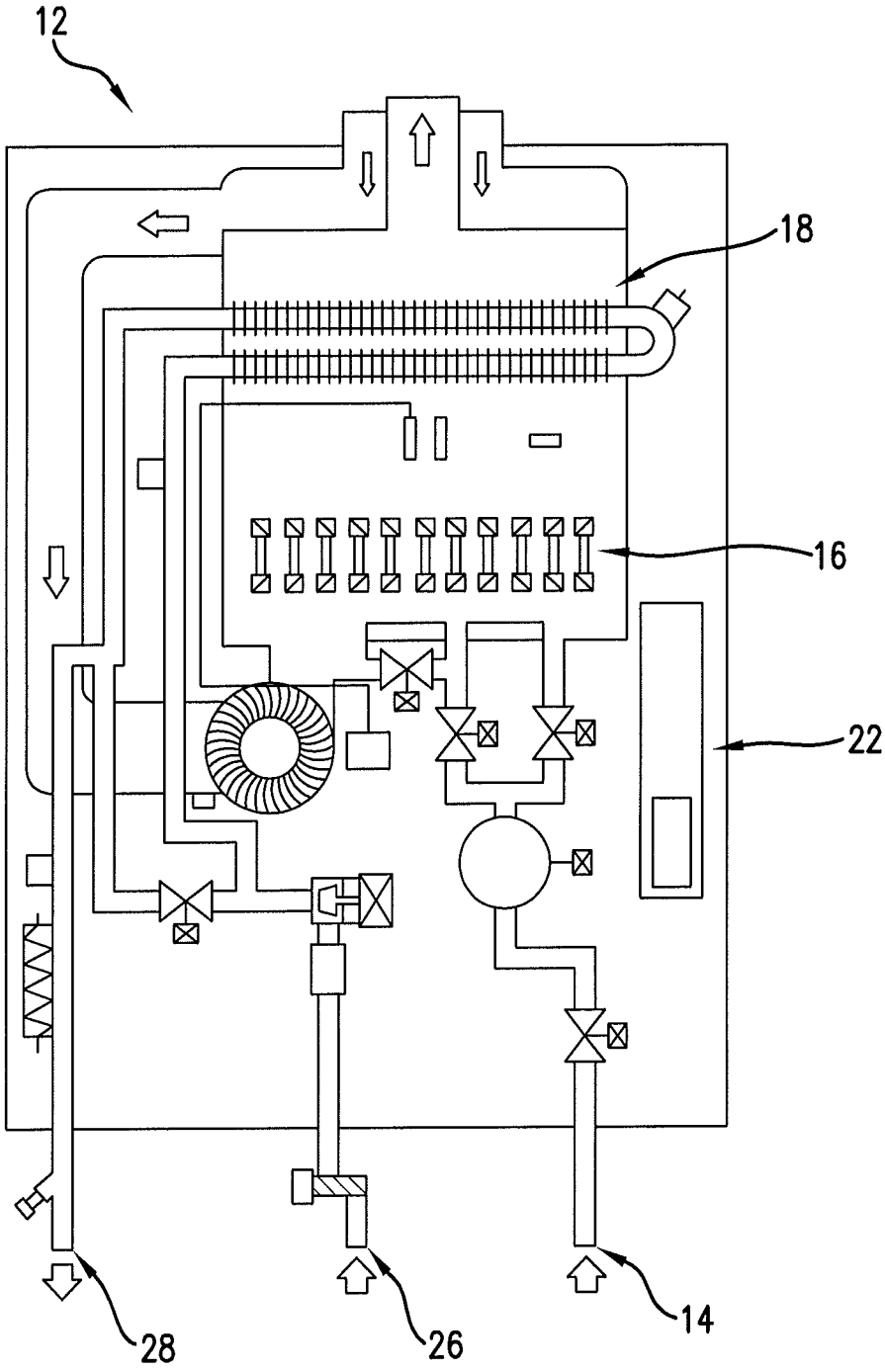
FIG. 2 is a schematic front view of a water heater used in the system of FIG. 1.
Figure 3:
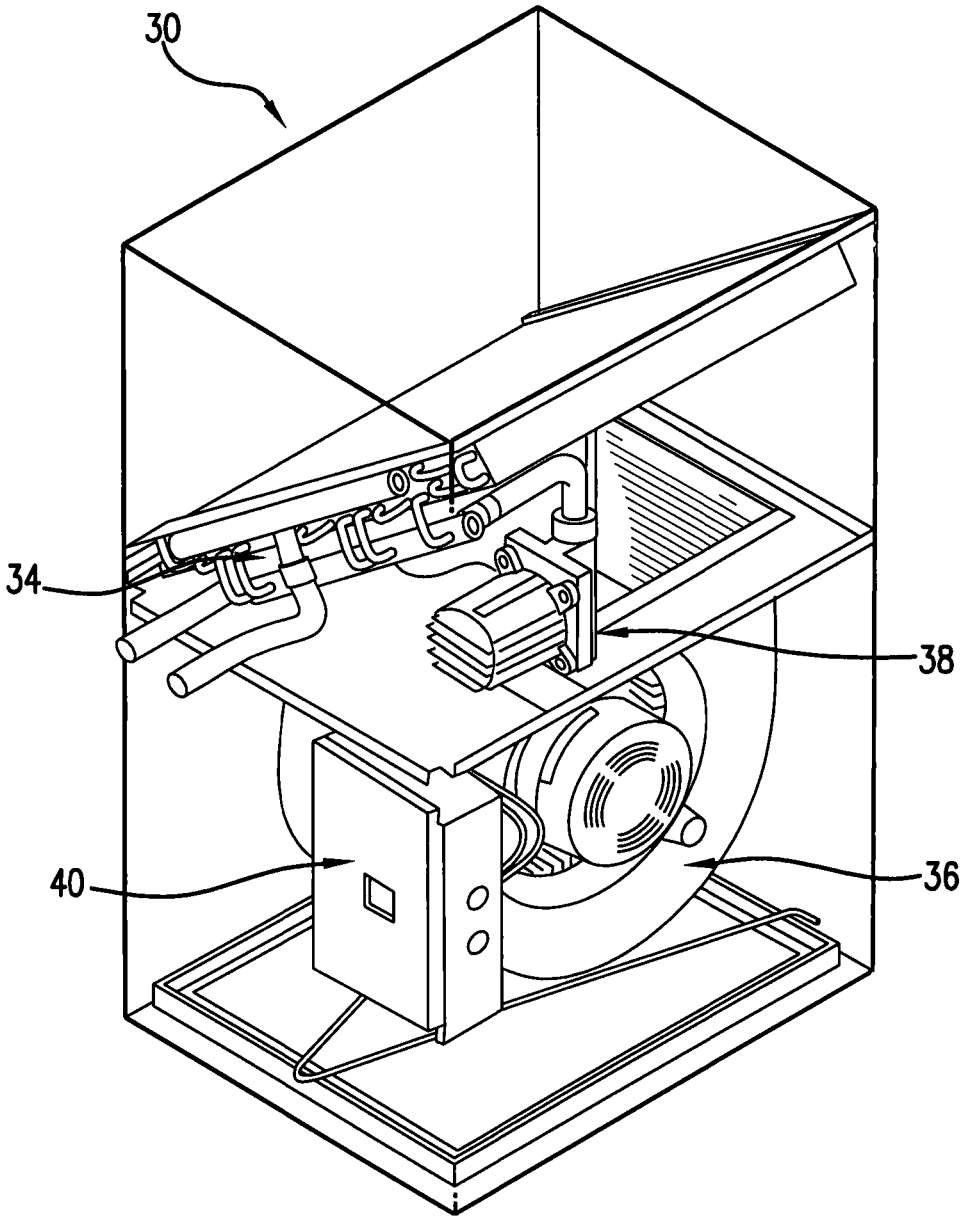
FIG. 3 is a schematic front view of an air handler used in the system of FIG. 1

Turning now to the drawings generally and FIGS. 1-3 in particular, a system 10 for generating heated air from hot water is shown. Water heater 12 is a tankless water heater, although it can be any type of water heater, tankless or otherwise, including but not limited to boilers or other sources of hot water. Thus, the term "water heater" is intended to be a broad term encompassing all devices that heat water. Water heater 12 receives fuel from fuel supply line 14 which is used to generate heat in burner 16. Burner 16 provides heat to heat exchanger 18 which transfers heat generated in burner 16 into water flowing through water heater 12. Water is passed or flowed through water heater 12 with pump 38 of an air handler 30. Pump 38, among other things, is operated or controlled by air handler controller 40.

Cold water from a cold water source (not shown) is supplied through cold water supply line 24. Cold water flows into water heater 12 through cold water supply line 26. Hot water flows outwardly of water heater 12 through hot water supply line 28. Hot water flows into air handler 30 as shown through air handler hot water supply line 32.

Air handler 30 includes a heat exchanger 34 that works in conjunction with a pump 38 and controller 40 which flows hot water from water heater 12 into heat exchanger 34. Heat exchanger 34 works in conjunction with a fan/blower 36 to supply heated air to the desired space to be heated. Fan/ blower 36 works in conjunction with controller 40. Any number of types of air handlers may be used in addition to the type shown in FIG. 3. For example, the air handler can be a hydronic furnace or the like. Thus, the term "air handler" is intended to be a broad term encompassing all devices capable of transferring heat from a water source to air and then moving that air toward a space to be heated.

Water passing through heat exchanger 34 exits air handler 30 through air handler return water line 42 and can be recirculated to water heater 12 by way of cold water supply line 26. Also, the system 10 is configured so that hot water generated by water heater 12 can also pass through hot water supply outlets 44 for general potable water uses. A sensor 43 detects or senses indicia of water flow. This can be the fact that water is flowing or not flowing or the rate of water flow (such as 4 gpm, for example).

Figure 4:
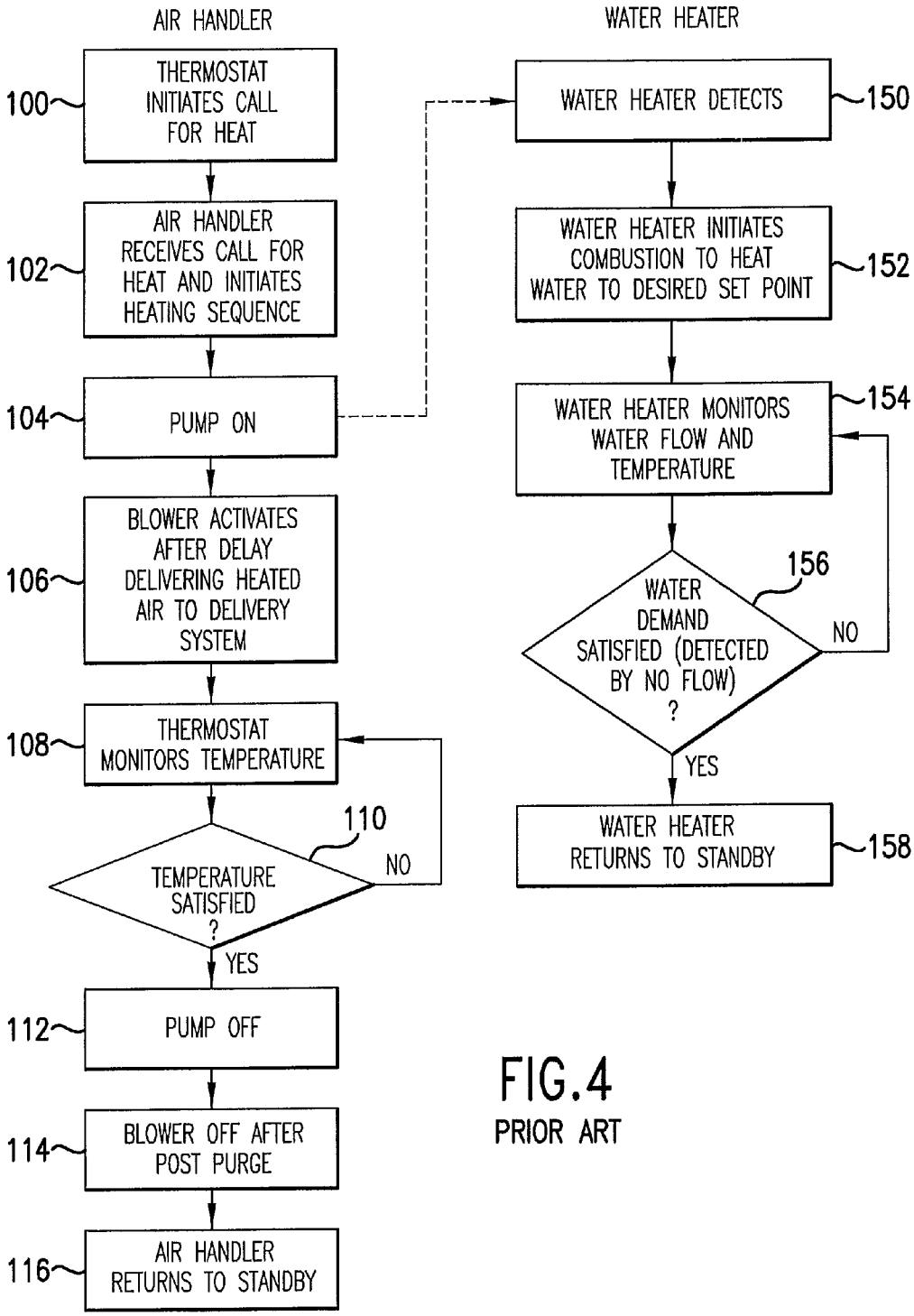
FIG.4 PRIOR ART
FIG. 4 is a logic diagram of a conventional air handler/water heater system.

As shown in FIG. 4, conventional systems for heating air with hot water are essentially stand alone systems that operate independently of each other. This can result in the problems of inadequate supply of water flow and/or inadequate supply of hot water to the air handler. In operation, the air handler receives a call for heat from a thermostat 20 shown in FIG. 1 in the usual manner at block 100 and initiates the usual heating sequence at block 102. This causes the air handler pump of block 104 to turn on which in turn activates the blower either immediately or after a short delay at block 106. The thermostat in the space to be heated continuously monitors the temperature at block 108 and if the set temperature is not satisfied, the system continues to run as indicated at block 110. When the desired temperature is reached or satisfied, the pump turns off, at block 112 followed by the blower turning off at block 114 and the air handler returns to stand-by at block 116.

In the meantime, when the pump is initially turned on, the water heater has a flow sensor/detector as indicated in block 150 which causes the water heater to initiate combustion to create hot water at block 152. The water heater continues to monitor the water flow and temperature. As long as the water heater continues to detect water flow at block 154, operation of the burner is maintained to create hot water. Once the flow has stopped as indicated at block 156, the water heater returns to stand-by at block 158. As noted above, however, this can result in particular situations where the water heater also supplies domestic potable water and there is insufficient water flow and/or insufficiently heated water to adequately supply the air handler. This can result in cavitation of the impeller in the air handler pump, thereby shortening its life. Also, the water supplied to the heat exchanger of the air handler may be inadequate to heat the air, whereby the air handler supplies cold air instead of the desired heated air.

My systems take a different approach. One approach is described with reference to FIG. 5. In that case, a thermostat in the space to be heated initiates a call for heat at block 200. Air handler 30 receives that call for heat and checks for the presence of a signal generated by water heater 12 as indicated at block 202. This is the first difference from conventional systems.

Figure 5:
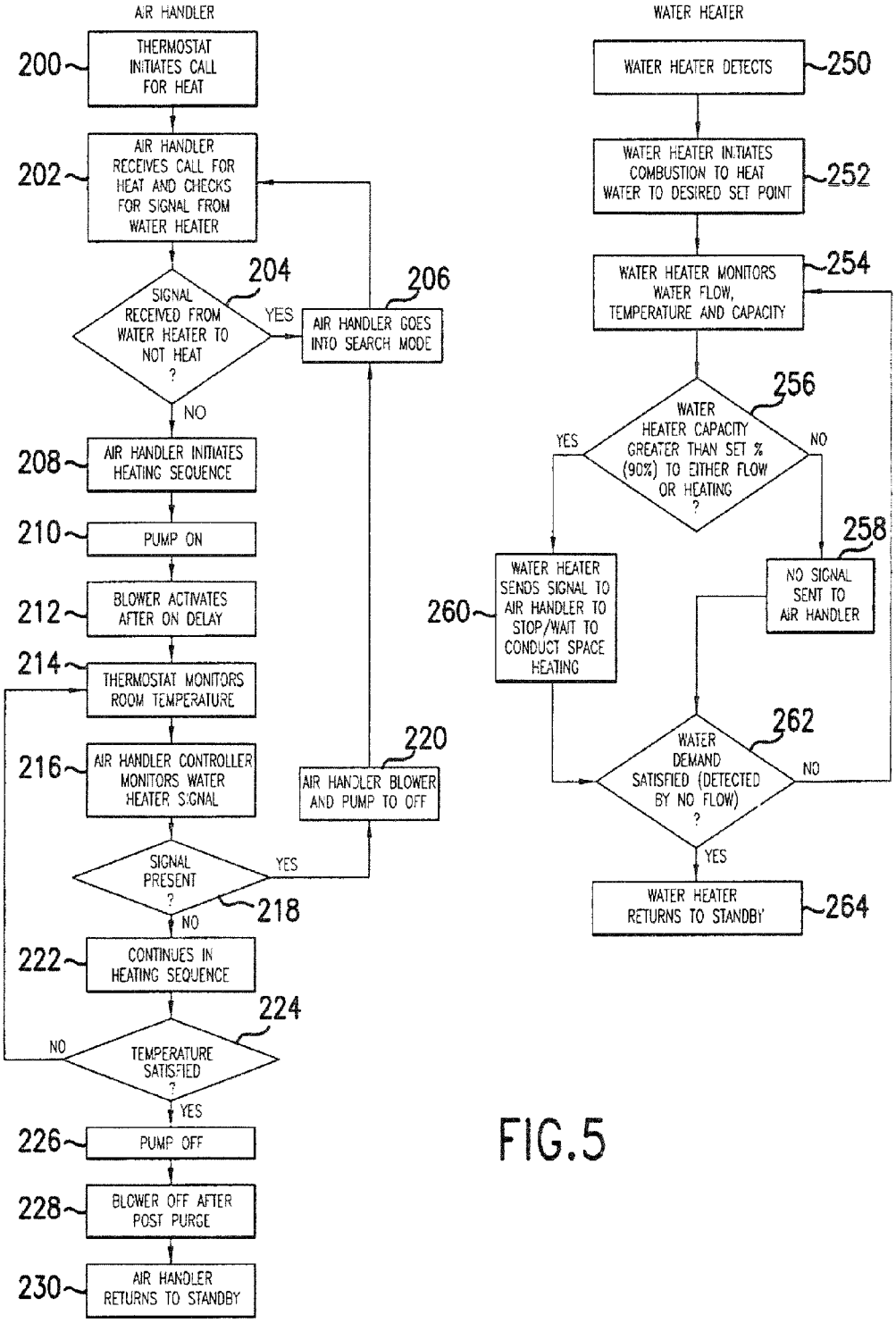
FIG. 5 is a logic diagram of the operational steps of an air handler/water heater systems.

As shown on the right hand side of FIG. 5 at block 250, water heater 12 is configured in the usual manner so that it can detect/sense a flow of water. When flow is detected/sensed at sensor 43, the water heater initiates a sequent to engage burner 16 in the usual manner at block 252. Water heater 12 then continuously monitors the water flow at block 254. However, during such monitoring, the water heater 12 also checks at block 256 to see whether the water flow is greater than or equal to about 90% of the flow capacity of water heater 12. Also, the water heater may determine for a selected period of time that the water flow is greater than about 90% of the capacity of the water heater. If the actual water flow is less than about 90% of the maximum water flow capacity of water heater 12, no signal is sent to air handler 30 at block 258.

On the other hand, if water heater 12 determines that the actual water flow is greater than about 90% of the maximum capacity of water flow of water heater 12 in block 256, either directly or over a period of time, water heater 12 generates a signal in block 260 and transmits that signal to controller 40 of air handler 30. When the detector/sensor indicates that the water flow has stopped at block 262, water heater 12 returns to stand-by at block 264.

Referring to the left hand side of FIG. 5, controller 40 of air handler 30 detects/senses receipt or non-receipt of the signal from water heater 12 at block 204. If a signal is received at block 206, the air handler does not initiate pump 38 or fan/blower 36. Instead, it continues to monitor the presence of the signal from water heater 12 at block 204.

On the other hand, if controller 40 of air handler 30 does not detect/sense a signal from water heater 12, then air handler 30 initiates its usual heating sequence at block 208 of initiating operation of 1) pump 38 at block 210 to supply hot water from water heater 12 and 2) blower 36 at block 212 to generate heated air by way of heat exchanger 34.

As that sequence progresses, the thermostat continues to monitor the temperature of the space at block 214 and controller 40 of air handler 30 continues to monitor signals received from water heater 12 at block 216. If the signal is present at block 218 during operation of the pump 38 or fan/blower 36 sequence, controller 40 of air handler 30 terminates operation of fan/blower 36 and pump 38 at block 220 and enters into a continuous monitoring mode.

On the other hand, so long as a signal is not received from water heater 12, the pump 38 and fan/blower 36 sequence continues at block 222 until the thermostat in the space to be heated terminates the call for heat at block 224. At that point, operation of pump 38 is terminated at block 226 and operation of fan/blower 36 is also terminated at block 228. Air handler 30 then returns to a stand-by mode at block 230.

In the case of both water heater 12 and air handler 30, controllers 22 and 40 may generate and receive the signals, respectively. Also, controller 22 may be linked to operation of burner 16. Similarly, controller 40 may be linked to operation of pump 38 and fan/blower 36. There can also be a connection between controllers 22 and 40. Of course, those skilled in the art are well aware that the above mentioned connections between these various components may either be by wire, wireless or other types of connections such as optical fibers and the like. The mode of connection is not important so long as the relevant connections are made.

The operation of water heater 12 which monitors whether the actual flow of water is more than or less than about 90% of the water flow capacity of water heater 12 assists in supplying adequate water to pump 38 to avoid the aforementioned cavitation of the impeller. Also, such monitoring of the capacity helps to ensure that the temperature of the heated water is sufficiently high to provide hot water to heat exchanger 34 of air handler 30. If the temperature of the hot water is too low, then heat exchanger 34 will not be able to extract enough heat from the water to adequately provide heated air. One example of a calculation concerning the 90% determination is set forth below.

$$\boxed{Lff} = \frac{\boxed{Qmax}}{\boxed{Tqset} - \boxed{Tin}}$$

| | | | |
|---|---|---|---|
| Tin (F) | Inlet temp. | 50 | ←put the inlet temperature |
| Lff max(GPM) | Max water flow by design | 8.5 | ←put Max water flow by design. ex. V2532 is 8.5 GPM |
| Lff (GPM) | MAX hot water capacity | 3.537777778 | ←compare the unit max limit water flow. |

$\overset{Lff}{\boxed{3.537777778}} \leq \overset{Lff\ max}{\boxed{8.5}}$ ← if this formula is correct, Lff is Lff.

$\overset{Lff}{\boxed{3.537777778}} > \overset{Lff\ max}{\boxed{8.5}}$ ← if this formula is correct, Lff is Lff max It is also possible for water heater 12 to continue to send the signal until the actual flow rate through water heater 12 is less than or equal to about 70% of the maximum water flow capacity of water heater 12. Further, the selected level can be varied from capacities other than 90% or 70%. What is important is that levels be selected to fit the individual circumstances whether they be about 90% or otherwise. Also, as mentioned above, it is possible for not only the capacity to be monitored, but for the capacity over a selected period of time to be monitored. In other words, the signal generated from controller 22 of water heater 12 can be set so that the signal is generated only if the flow rate is greater than about 90% of maximum water flow rate for a selected period of time. Thus, a momentary flow rate exceeding 90% would not trigger generation of the signal unless the flow rate was over about 90% for a selected period of time such as for about 30 seconds. This time can be varied anywhere between 0 and 1 minute or even more if desired.

It is also possible for the signal, once generated, to continue until the actual flow rate through water heater 12 is less than or equal to 70%. Thus, controller 40 of air handler 30 will only reinitiate the space heating sequence when the flow rate through water heater 12 is less than or equal to about 70%. This too can be monitored for a selected period of time such as about 30 seconds or for a range of time between down to 0 and up to a minute or even more if desired.

It is also possible for the signal process to be reversed. In other words, water heater 12, as described above, generates a signal when conditions are not optimal for initiation of operation of air handler 30. This can be reversed so that water heater 12 generates the signal when the conditions are optimal.

Figure 6:
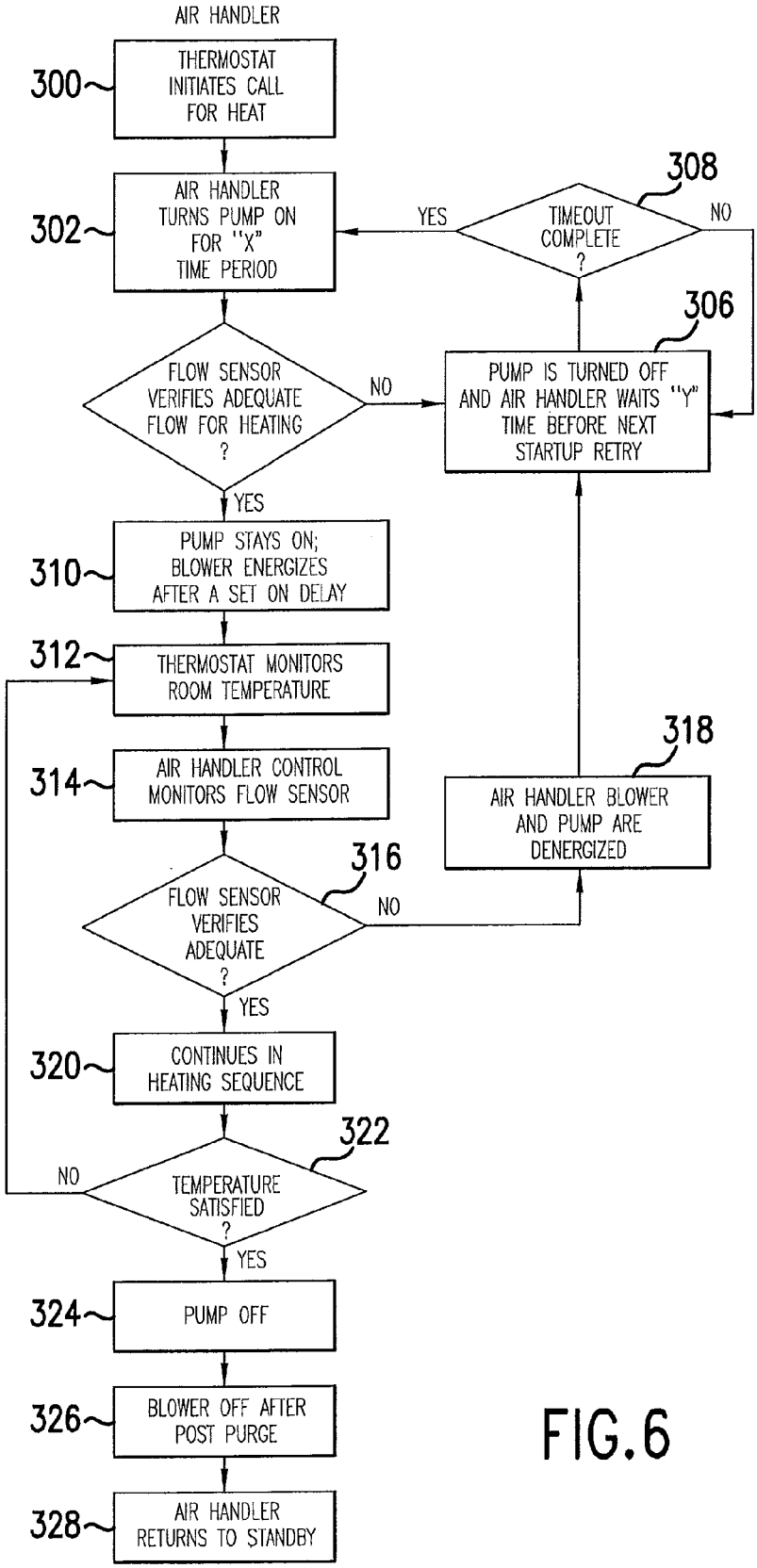
FIG. 6 is a logic diagram of the operational steps of another air handler/water heater systems.

FIG. 6 shows another air handler operational mode that works in conjunction with an air handler such as an air handler 30 of the type shown in FIG. 4. In that case, a thermostat initiates a call for heat in the space to be heated in block 300. The air handler 30 initiates operation of pump 38 for a selected period of time at block 302. That selected period of time "X" can be any time such as about 30 seconds, for example. Then, air handler 30 detects whether the flow of water through air handler 30 is sufficient to provide for enough hot water to generate heated air by way of heat exchanger 34.

If the sensed flow is determined to be inadequate, operation of pump 38 is terminated at block 306 and air handler 30 waits for another selected time period "Y" before initiating a second startup call. Controller 40 utilizes a "time out" sequence at block 308 to allow the passage of some amount of time such as about 15 or about 30 seconds or any other time out period and reinitiates the operation of pump 38 for the selected "X" time period.

If the flow sensor verifies that there is sufficient water flow for heating, operation of pump 38 is maintained and fan/blower 36 is energized either immediately or after a set delay at block 310.

The thermostat continues to monitor the temperature of the space to be heated at block 312 and air handler 30 continues to monitor the flow of water to determine at block 314 whether the flow of water to the exchanger continues to be adequate. If at any time air handler 30 detects that the flow of water is inadequate at block 316, controller 40 deactivates pump 38 and fan/blower 36 at block 318 and moves into the time out mode at block 306.

On the other hand, so long as the flow rate of water is determined to be adequate at block 316, the heating sequence continues at block 320 until the thermostat terminates the call for heat at block 322. At that point, operation of pump 38 is terminated at block 324 as is the operation of fan/blower 36 at block 326. Air handler 30 then returns to stand-by at block 328.

A variety of modifications to the representative structures described will be apparent to those skilled in the art from the disclosure provided herein. Thus, my technology may be embodied in other specific forms without departing from the spirit or essential attributes thereof and, accordingly, reference should be made to the appended claims, rather than to the foregoing specification, as indicating the scope of my technology.

What is claimed is:

1. A method of heating air in an air handler from hot water generated in a water heater comprising:

a. receiving a call for heated air;

b. automatically initiating operation of a pump associated with the air handler;

c. continuing operation of the pump for a predetermined first period of time;

d. detecting whether a flow of water through the pump is at a predetermined level sufficient to generate heated air from the hot water;

e. responsive to detecting that flow of water through the pump not at or above said predetermined level sufficient to generate heated air flow from the hot water, terminating operation of the pump for a second period of time;

f. repeating the initiating, continuing and detecting steps;

g. responsive to detecting that flow of water through the pump, if is below said predetermined level sufficient to generate heated air from the hot water, maintaining the pump in operation;

h. initiating operation of a fan to supply heated air generated by heat exchange with the hot water; and i. automatically terminating operation of at least one of the pump, and the fan when the call for heat is satisfied.

2. The method of claim 1, wherein the water heater is tankless.

3. The method of claim 1, wherein the predetermined flow level is less than about 70% of a maximum water flow level associated with the water heater over a selected time period.

4. The method of claim 1, wherein the predetermined flow level is about 90% of the maximum water flow associated with the water heater over a selected time period.

5. The method of claim 4, wherein first predetermined time period is about 30 seconds.

6. A method of heating air in an air handler from hot water generated in a water heater comprising:

a. receiving a call for heated air;

b. automatically initiating operation of a pump associated with the air handler;

c. detecting whether flow of water through the pump is at a selected level sufficient to generate heated air from the hot water;

d. if not, terminating the operation of the pump, waiting a period of time and repeating step c;

e. if so, maintaining the pump in operation and initiating operation of a blower/fan to supply heated air generated by heat exchange with the hot water; and f. automatically terminating operation of the pump and/or the blower/fan when the call for heat is terminated satisfied.

7. The method of claim 6, further comprising generating a signal in the presence or absence of the flow of water at the selected level.

8. The method of claim 7, wherein, when the flow of water is below the selected level, operation of the pump and/or blower/fan is terminated and, after a selected time period elapses, the flow of water is re-verified.

9. The method of claim 6, further comprising terminating operation of the fan after the call for heated air is satisfied.

* * * * *